US007039965B1

(12) United States Patent
Ismert

(10) Patent No.: US 7,039,965 B1
(45) Date of Patent: May 9, 2006

(54) NOTCHED PLUMBING SUPPORT BRACKET

(75) Inventor: Joseph P. Ismert, Kansas City, MO (US)

(73) Assignee: Sioux Chief Manufacturing Co., Inc., Pecultar, MO (US)

( * ) Notice: Subject to any disclaimer, the term of this patent is extended or adjusted under 35 U.S.C. 154(b) by 195 days.

(21) Appl. No.: 10/704,490

(22) Filed: Nov. 7, 2003

(51) Int. Cl.
*E03C 1/042* (2006.01)

(52) U.S. Cl. ..... 4/695; 248/56; 248/68.1

(58) Field of Classification Search ..... 4/695, 4/696; 248/56, 65, 49, 68.1, 74.3, 57, 115
See application file for complete search history.

(56) References Cited

U.S. PATENT DOCUMENTS

| | | | | |
|---|---|---|---|---|
| 2,980,404 | A * | 4/1961 | Andersen et al. | 248/68.1 |
| 4,550,451 | A | 11/1985 | Hubbard | |
| 4,618,114 | A * | 10/1986 | McFarland | 248/65 |
| 4,909,461 | A | 3/1990 | Collins | |
| 4,957,251 | A | 9/1990 | Hubbard | |
| 5,593,115 | A * | 1/1997 | Lewis | 248/68.1 |
| 5,833,179 | A * | 11/1998 | VandenBerg | 248/65 |
| 5,971,329 | A * | 10/1999 | Hickey | 248/68.1 |
| 6,375,128 | B1 | 4/2002 | Condon et al. | |

OTHER PUBLICATIONS

Photograph of Holdrite® 101-18 plumbing bracket manufactured by Hubbard Enterprises and believed to have been on sale for more than one year prior to the filing date of the present application.

Photograph of Holdrite® 107-18 plumbing bracket manufactured by Hubbard Enterprises and believed to have been on sale for more than one year prior to the filing date of the present application.

Photograph of Holdrite® 108-20 plumbing bracket manufactured by Hubbard Enterprises and believed to have been on sale for more than one year prior to the filing date of the present application.

Photograph of Holdrite® 601-20 plumbing bracket manufactured by Hubbard Enterprises and believed to have been on sale for more than one year prior to the filing date of the present application.

* cited by examiner

*Primary Examiner*—Khoa D. Huynh
(74) *Attorney, Agent, or Firm*—Erickson & Kleypas, L.L.C.

(57) ABSTRACT

A plumbing support bracket for supporting plumbing pipes between structural members comprises a pair of end tabs and a center section between the end tabs. The end tabs are bendable relative to the center section. The center section has opposed first and second edges with a plurality of pipe receiving notches formed in the first edge. The center section further includes a row of longitudinally spaced pipe receiving holes. The center section is made more rigid than the end tabs by first and second ribs. The first rib comprises a flange formed along the second edge of the bracket and the second rib comprises an elongate longitudinal bulge formed in the body between the bases of the pipe receiving notches and the row of pipe receiving holes.

33 Claims, 2 Drawing Sheets

NOTCHED PLUMBING SUPPORT BRACKET

BACKGROUND OF THE INVENTION

1. Field of the Invention

This invention relates to the field of plumbing hardware, and in particular to a bracket for supporting plumbing pipes between building members.

2. Description of the Related Art

Plumbing support brackets of the type used to locate and support plumbing pipes in a bay between building members are well known in the art. These brackets are especially useful in locating stub-outs for faucets, showerheads, and the like between wall studs. U.S. Pat. No. 4,550,451 to Hubbard discloses a simple bracket having pipe receiving openings spaced along its entire length. The bracket is attachable to the outer edges of adjacent studs by inserting fasteners such as nails or screws through fastener openings located intermediate the pipe receiving openings.

U.S. Pat. No. 4,909,461 to Collins describes an improved bracket having pipe receiving notches in addition to the pipe receiving holes. The notches have flanges around their bases which allow the pipes to be snapped into position and then soldered in place. The bracket includes a mounting tab at each end. The bracket is attachable to the studs by a pair of locating tabs which are formed on each mounting tab and can be hammered into the outer edges of adjacent studs. The mounting tabs are not adapted to be bent so that the bracket can be attached to adjacent stud faces between the studs. The center portion of the bracket between the mounting tabs is stiffened by a flange along its lower edge.

In order to allow plumbing pipes to be soldered to the brackets, prior art plumbing brackets have been coated with copper oxide after fabrication, a process which produces a very thin layer of copper which can easily burn off during soldering, thereby exposing the steel and creating the potential for galvanic action with the pipes, which can cause leaks.

SUMMARY OF THE INVENTION

The present invention comprises a plumbing support bracket having a center section and a pair of end tabs which are bendable relative to the center section so that the bracket can be attached either to adjacent stud faces between the studs or to the outer edges of the studs. The center section has a plurality of pipe receiving notches formed in its upper edge and a row of longitudinally spaced pipe receiving holes. The center section is made more rigid than the end tabs by first and second ribs. The first rib comprises a flange formed along the lower edge of the bracket and the second rib comprising an elongate longitudinal bulge formed between the bases of the pipe receiving notches and the row of pipe receiving holes.

The bracket is formed of relatively thin steel, for example 0.032–0.048 inches thick, which is plated with relatively pure copper before the bracket is fabricated. Circumferential flanges are formed around each pipe receiving hole and around the bases of the pipe receiving notches. The thin metal allows the end tabs to be easily bent and the copper plating allows the plumbing pipes to be soldered to the circumferential flanges.

DETAILED DESCRIPTION OF THE PREFERRED EMBODIMENTS

Figure 1:
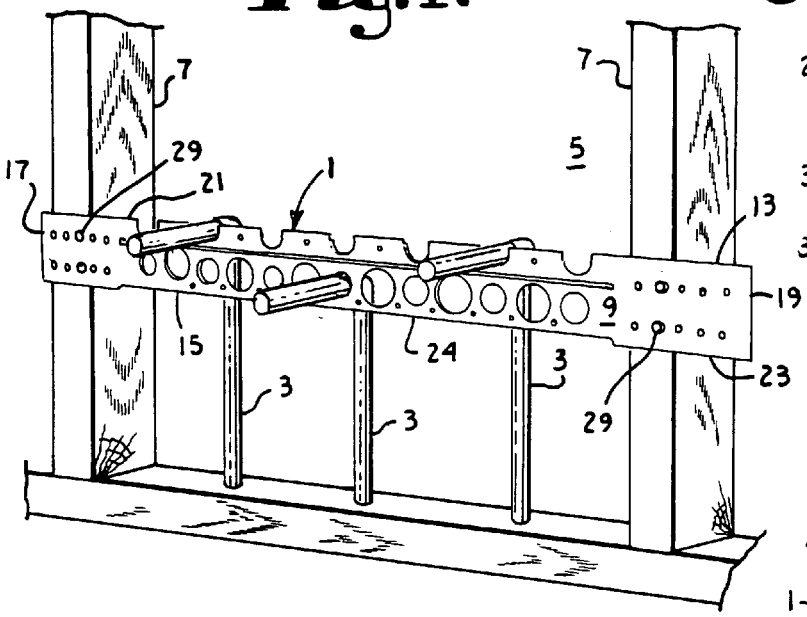
FIG. 1 is a perspective view showing a plumbing support bracket according to the present invention mounted between two building members by fastening a mounting tab of the bracket to an outer face of each building member.
Figure 3:
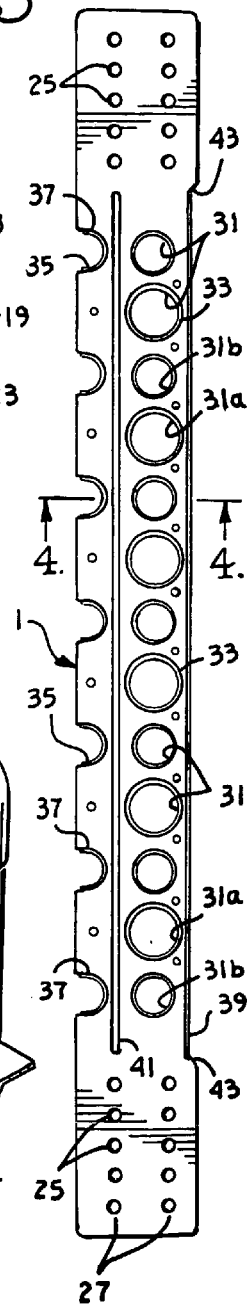
FIG. 3 is a plan view of the bracket showing the back face of the bracket.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference number 1 generally designates a plumbing support bracket according to the present invention. The bracket 1 is used for supporting plumbing pipes 3 in a bay 5 between building members 7, such as studs.

The bracket 1 is preferably formed of relatively thin sheet steel, for example 0.032–0.048 inches thick, which is plated with pure copper. The copper plating is applied to the steel before fabrication of the bracket 1 and allows solder to adhere to the bracket 1 so that the plumbing pipes 3 may be soldered to the bracket 1.

Figure 2:
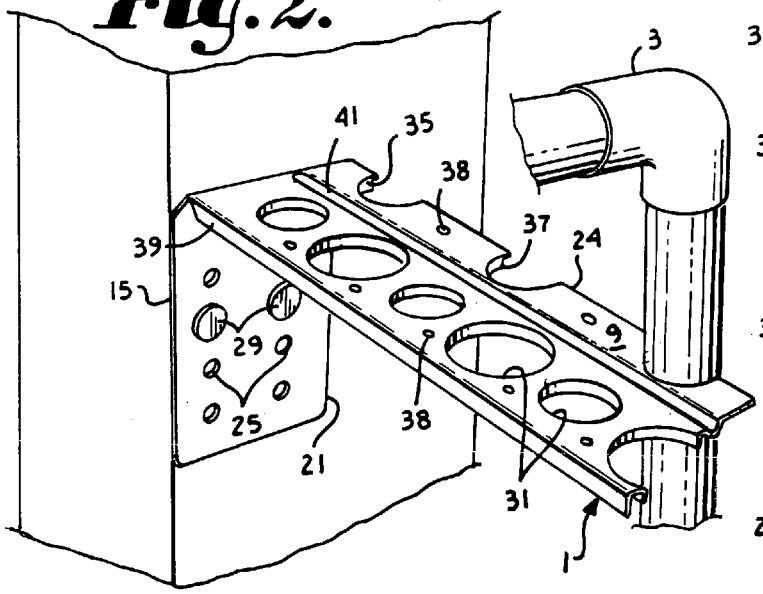
FIG. 2 is a perspective view showing a plumbing support bracket according to the present invention mounted between two building members by bending the mounting tabs of the bracket relative to the center section and fastening the mounting tabs to adjacent faces of the building members.
Figure 4:
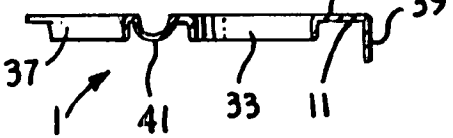
FIG. 4 is a cross sectional view of the bracket taken generally along line 4—4 in FIG. 3.

The bracket 1 includes a first or front face 9, a second or back face 11, a first or top edge 13, a second or bottom edge 15, and opposed first and second ends 17 and 19, respectively. A first end tab 21 is positioned proximate the first end 17 and a second end tab 23 is positioned proximate the second end 19. Between the end tabs 19 and 21 is a center section 24. The end tabs 21 and 23 each include a plurality of fastener holes 25, which are laid out in two parallel rows 27. The fastener holes 25 are sized to receive a fastener 29, such as a nail or screw used to secure the bracket 1 to the building members 7. The end tabs 21 and 23 are easily bendable relative to the center section 24 such that the bracket 1 can be installed between the building members 7, as shown in FIG. 2. The end tabs 21 and 23 are left unbent when the bracket 1 is to be installed by fastening the tabs 21 and 23 to the outer edges of the respective building members 7 as shown in FIG. 1.

The center section 24 includes a plurality of longitudinally spaced pipe receiving holes 31, each of which is sized to receive a respective plumbing pipe 3. The pipe receiving holes 31 are shown as including six larger holes 31*a* sized to receive ¾" CTS (Copper Tube Size) pipe 3 and seven smaller holes 31*b* sized to receive ½" CTS pipe 3. The holes 31*a* and 31*b* are shown as being arranged in an alternating pattern and centered along a line extending parallel to the top and bottom edges 13 and 15 of bracket 1. Each pipe receiving hole 31 includes a circumferential flange 33 which extends outwardly from the back face 11 of the bracket 1. The flanges 33 each provide a surface to which a respective plumbing pipe 3 may be soldered.

The center section 24 also includes a plurality of pipe receiving notches 35 formed along the top edge 13 of the bracket 1. Each of the pipe receiving notches 35 is sized to receive a respective plumbing pipe 3 and includes a flange 37 which extends outwardly from the back face 11 of the bracket 1 around the base of the notch. Each flange 37 preferably comprises a portion of a circle which is slightly more than 180 degrees such that the respective plumbing pipe 3 will snap into place when inserted into the respective notch 35. Each flange 37 then serves as a surface to which the respective pipe 3 can be soldered. The bracket 1 is shown as having seven notches 35 in alignment with the smaller pipe receiving holes 31*b*. As shown, the notches 35 are sized to receive ½" CTS pipe 3.

The center section 24 is preferably approximately fourteen inches in length to fit within a bay 5 between building members 3 on standard sixteen inch centers. The end tabs 19 and 21 are preferably approximately three inches in length so as to provide an overall length of approximately twenty inches, which is generally sufficient to allow the bracket 1 to lay flat across two building members 7. The pipe receiving holes 31*a* and 31*b*, as well as the notches 35, are preferably spaced on approximately two inch centers. Additional fastener receiving holes 38 are spaced along the length of the center section 24.

The end tabs 19 and 21 are easily bendable due to the thinness of the metal used to form the bracket 1, whereas the center section 24 is made rigid by first and second reinforcing ribs 39 and 41, respectively. The first reinforcing rib 39 comprises a flange formed along the bottom edge 15 of the bracket 1 by making a respective triangular cut 43 proximate each end of the center section 24 and bending the intervening portion of the bracket 1 outwardly at a right angle toward the back face 11. The second reinforcing rib 41 is stamped into the bracket 1 between the pipe receiving holes 31 and the pipe receiving notches 35 and comprises an elongate depression or gutter when seen from the front face 9 and an elongated bulge or blister when viewed from the back face 11. The second reinforcing rib 41 is shown as being tangential to both the flanges 37 of the pipe receiving notches 35 and the flanges 33 of the larger pipe receiving holes 31*a*.

The first and second reinforcing ribs are preferably approximately fourteen inches long. When the end tabs 19 and 21 are bent, to extend perpendicular to the center section 24, the length of the bracket 1 from the outwardly directed front face 9 of one end tab 19 to the other end tab 21 is approximately fourteen and one-half inches and sized to fit between two adjacent studs on sixteen inch centers. The bracket 1 can therefore be oriented between studs 7 with the front face of the 9 center section 24 extending generally perpendicular to the floor or ground or parallel thereto as shown in FIG. 2. Such an orientation is desirable to facilitate use of the bracket 1 to support vertically running lengths of pipe 3.

In a preferred embodiment, the distance from the bottom edge 15 of the bracket 1 and the radial center of each pipe receiving notch 35 is approximately 1½" (1.5") to 1⅞" (1.875"). This distance spaces the notch 35 approximately halfway between the front and rear edges of a vertically extending 2×4 stud, when the bracket 1 is positioned as shown in FIG. 2 with the bottom edge 15 extending in alignment with the front or rear edges of adjacent studs.

ALTERNATIVE EMBODIMENT

Figure 5:
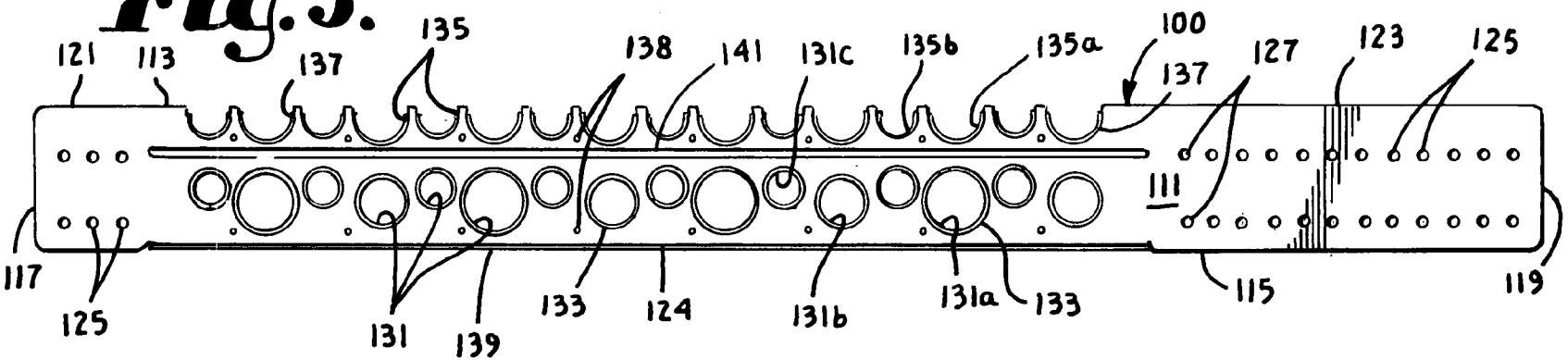
FIG. 5 is a view similar to FIG. 3 showing an alternative embodiment of the bracket.

An alternative embodiment of the present invention designed for use with building members on twenty-four inch centers is shown in FIG. 5 and indicated by the reference numeral 100. The bracket 100 includes a front face (not shown), a back face 111, a top edge 113, a bottom edge 115, and opposed first and second ends 117 and 119, respectively. A first end tab 121 is positioned proximate the first end 117 and a second end tab 123 is positioned proximate the second end 119. Between the end tabs 121 and 123 is a center section 124. The end tabs 121 and 123 each include a plurality of fastener holes 125, which are laid out in two parallel rows 127.

The center section 124 includes a plurality of longitudinally spaced pipe receiving holes 131, each of which are sized to receive a respective plumbing pipe 3. The pipe receiving holes 131 are shown as including four large holes 131*a* sized to receive 1" CTS pipe 3, four intermediate holes 131*b* sized to receive ¾" CTS pipe 3, and eight small holes 131*c* sized to receive ½" CTS pipe 3. The holes 131 are shown as being arranged a pattern wherein every other hole 131 is a small hole 131*c* and the remaining holes alternate between large holes 131*a* and intermediate holes 131*b*. The large holes 131*a* and intermediate holes 131*b* are centered along a line extending parallel to the top and bottom edges 113 and 115 of bracket 100. The small holes 131*c* are centered along a line offset from and extending parallel to the line on which the large holes 131*a* and intermediate holes 131*b* are centered. In other words, the small holes 131*c* are located or centered on a first centerline which is laterally offset from a second centerline along which the large holes 131*a* and intermediate holes 131*b* are located or centered.

Each pipe receiving hole 131 includes a circumferential flange 133 which extends outwardly from the back face 111 of the bracket 100. The flanges 133 each provide a surface to which a respective plumbing pipe 3 may be soldered.

The center section 124 also includes a plurality of pipe receiving notches 135 formed along the top edge 113 of the bracket 100. The pipe receiving notches 135 alternate between larger notches 135*a* sized to receive a ¾" CTS pipe 3 and smaller notches 135*b* sized to receive a ½" CTS pipe 3. Each notch 135 includes a flange 137 which extends outwardly from the back face 111 of the bracket 100 around the base of the notch. Each flange 137 preferably comprises a portion of a circle which is slightly more than 180 degrees such that the respective plumbing pipe 3 will snap into place when inserted into the respective notch 135. Each flange 137 then serves as a surface to which the respective pipe 3 can be soldered. The bracket 100 is shown as having eight smaller notches 135*b* in alignment with the small pipe receiving holes 131*c* and eight larger notches 135*a* in alignment with the large holes 131*a* and intermediate holes 131*b*.

The small pipe receiving holes 131*c* and the pipe receiving notches 135*a* and 135*b*, are preferably spaced on approximately two inch centers. The large pipe receiving holes 131*a* and intermediate pipe receiving holes 131*b* are each spaced on 4" centers. Additional fastener receiving holes 138 are spaced along the length of the center section 124.

The center section 124 is offset toward the first end 117 of the bracket 100 such that end tab 121 is considerably shorter than end tab 123. For example, the embodiment shown is a twenty-six inch bracket 100 having a 2" end tab 121 and a 6½" end tab 123. The additional length of the end tab 123 provides additional flexibility for installations where the building members 7 are on centers of greater than sixteen inches.

The end tabs 121 and 123 are easily bendable due to the thinness of the metal used to form the bracket 100, whereas the center section 124 is made rigid by first and second reinforcing ribs 139 and 141, respectively. The first reinforcing rib 139 comprises a flange formed along the bottom edge 115 of the bracket 100 by making a respective triangular cut 143 proximate each end of the center section 124 and bending the intervening portion of the bracket 100 outwardly at a right angle toward the back face 111. The second reinforcing rib 141 is stamped into the bracket 100 between the pipe receiving holes 131 and the pipe receiving notches 135 and comprises an elongate depression of gutter when seen from the front face 109 and an elongated bulge or blister when viewed from the back face 111.

It is to be understood that while certain forms of the present invention have been illustrated and described herein, it is not to be limited to the specific forms or arrangement of parts described and shown.

What is claimed and desired to be secured by Letters Patent is as follows:

1. A plumbing support bracket for supporting plumbing pipes between structural members, said bracket comprising a first face, a second face, a pair of end tabs and a center section between said end tabs, said end tabs being bendable relative to said center section, said center section having opposed first and second edges, said first edge having a plurality of pipe receiving notches formed therein, each of said notches having a flange, said center section further including a row of longitudinally spaced pipe receiving holes, said center section made more rigid than said end tabs by first and second reinforcing ribs, said first reinforcing rib comprising a flange formed along said second edge of said bracket and said second reinforcing rib comprising an elongate longitudinal depression when seen from the first face and an elongate longitudinal bulge when viewed from the second face, said second reinforcing rib formed between said flanges of said pipe receiving notches and said row of pipe receiving holes.

2. The plumbing support bracket as in claim 1 wherein said bracket is formed of copper plated steel.

3. The plumbing support bracket as in claim 2 wherein said copper plated steel is 0.032–0.048 inches thick.

4. The plumbing support bracket as in claim 2 wherein said bracket includes an outwardly extending circumferential flange surrounding each said pipe receiving hole.

5. The plumbing support bracket as in claim 2 wherein said bracket includes an outwardly extending flange surrounding each said base of each said pipe receiving notch.

6. The plumbing support bracket as in claim 5 wherein each said flange forms a portion of a circle slightly greater than 180 degrees.

7. The plumbing support bracket as in claim 1 wherein one of said end tabs is substantially longer than the other of said end tabs.

8. The plumbing support bracket as in claim 1 wherein each of said end tabs includes a plurality of fastener receiving holes.

9. The plumbing support bracket as in claim 8 wherein said fastener receiving holes in each said end tab are arranged in two parallel rows.

10. The plumbing support bracket as in claim 1 wherein said pipe receiving holes include first pipe receiving holes sized to receive plumbing pipe of a first diameter and second pipe receiving holes sized to receive plumbing pipe of a second diameter different from said first diameter.

11. The plumbing support bracket as in claim 10 wherein said first and second pipe receiving holes are arranged in an alternating pattern.

12. The plumbing support bracket as in claim 11 wherein said pipe receiving notches are in lateral alignment with said first pipe receiving holes.

13. The plumbing support bracket as in claim 12 wherein said pipe receiving notches are sized to receive a plumbing pipe of a diameter equal to said first diameter.

14. The plumbing bracket as in claim 1 wherein said pipe receiving notches include first pipe receiving notches sized to receive plumbing pipe of a first diameter and second pipe receiving notches sized to receive plumbing pipe of a second diameter different from said first diameter.

15. The plumbing bracket as in claim 14 wherein said first and second pipe receiving notches are arranged in an alternating pattern.

16. The plumbing support bracket as in claim 1 wherein said pipe receiving holes include first pipe receiving holes sized to receive plumbing pipe of a first diameter, second pipe receiving holes sized to receive plumbing pipe of a second diameter different from said first diameter, and third pipe receiving holes of a third diameter different from said first and second diameters.

17. The plumbing support bracket as in claim 16 wherein said pipe receiving holes are arranged in a patten wherein every other one of said pipe receiving holes is a first pipe receiving hole and the remainder of said pipe receiving holes alternate between said second pipe receiving holes and said third pipe receiving holes.

18. The plumbing support bracket as in claim 17 wherein said first pipe receiving holes are located on a first centerline which is laterally offset from a second centerline shared by said second and third pipe receiving holes.

19. The plumbing support bracket as in claim 17 wherein said pipe receiving notches include first pipe receiving notches sized to receive plumbing pipe of said first diameter and second pipe receiving notches sized to receive plumbing pipe of said second diameter.

20. The plumbing support bracket as in claim 19 wherein said first pipe receiving notches are in lateral alignment with said first pipe receiving holes and said second pipe receiving notches are in lateral alignment with said second and third pipe receiving holes.

21. The plumbing bracket as in claim 1 wherein said center section has a length selected to fit between adjacent wall studs spaced at standard intervals.

22. The plumbing bracket as in claim 1 wherein said first and second ribs have a length selected to be just shorter than the distance between two adjacent wall studs at standard intervals such that when said end tabs are bent at the ends of the first and second ribs, the distance between the outwardly directed faces of the bent end tabs is slightly less than the distance between two adjacent wall studs at standard intervals.

23. The plumbing bracket as in claim 1 wherein said first and second ribs are approximately fourteen inches long.

24. A plumbing support bracket for supporting plumbing pipes between structural members, said bracket comprising a first face, a second face, a pair of end tabs and a center section between said end tabs having opposed first and second edges and a row of longitudinally spaced pipe receiving holes formed therebetween, said first edge having a plurality of pipe receiving notches formed therein, each of said notches having a flange, said bracket being formed of relatively thin metal such that said end tabs are easily bendable, said center section made more rigid than said end tabs by first and second reinforcing ribs, wherein said first reinforcing rib comprises a flange formed along said second edge of said bracket and said second reinforcing rib comprises an elongate longitudinal depression when seen from the first face and an elongate longitudinal bulge when viewed from the second face, said second reinforcing rib formed between said flanges of said pipe receiving notches and said row of pipe receiving holes.

25. The plumbing support bracket as in claim 24 wherein said relatively thin metal is 0.032–0.048 inches thick.

26. The plumbing support bracket as in claim 24 wherein said relatively thin metal is copper plated steel.

27. The plumbing bracket as in claim 24 wherein said center section has a length selected to fit between adjacent wall studs spaced at standard intervals.

28. The plumbing bracket as in claim 24 wherein said first and second ribs have a length selected to be just shorter than the distance between two adjacent wall studs at standard intervals such that when said end tabs are bent at the ends of the first and second ribs, the distance between the outwardly directed faces of the bent end tabs is slightly less than the distance between two adjacent wall studs at standard intervals.

29. The plumbing bracket as in claim 24 wherein said first and second ribs are approximately fourteen inches long.

30. A plumbing support bracket for supporting plumbing pipes between structural members, said bracket comprising a first face, a second face, a pair of end tabs and a center section between said end tabs, each said end tab being bendable relative to said center section and including a plurality of fastener receiving holes, said center section having opposed first and second edges, said first edge having a plurality of pipe receiving notches formed therein, each said notch having an outwardly extending flange surrounding said notch, each said flange forming a portion of a circle slightly greater than 180 degrees, said center section further including a row of longitudinally spaced pipe receiving holes and an outwardly extending circumferential flange surrounding each said pipe receiving hole, said center section made more rigid than said end tabs by first and second reinforcing ribs, said first reinforcing rib comprising a flange formed along said second edge of said bracket and said second reinforcing rib comprising an elongate longitudinal depression when seen from the first face and an elongate longitudinal bulge when viewed from the second face, said second reinforcing rib formed between said flanges of said pipe receiving notches and said row of pipe receiving holes.

31. The plumbing support bracket as in claim 30 wherein one of said end tabs is substantially longer than the other of said end tabs.

32. The plumbing bracket as in claim 30 wherein said first and second ribs have a length selected to be just shorter than the distance between two adjacent wall studs at standard intervals such that when said end tabs are bent at the ends of the first and second ribs, the distance between the outwardly directed faces of the bent end tabs is slightly less than the distance between two adjacent wall studs at standard intervals.

33. The plumbing bracket as in claim 30 wherein said first and second ribs are approximately fourteen inches long.

* * * * *